US005338156A

United States Patent [19]

Chien

[11] Patent Number: 5,338,156

[45] Date of Patent: Aug. 16, 1994

[54] CEILING FAN BLADE

[76] Inventor: Kuo-Neng Chien, 4Fl., No. 27, Lane 160, Hsin Sheng S. Rd., Sec. 1, Taipei, Taiwan

[21] Appl. No.: 31,948

[22] Filed: Mar. 16, 1993

[51] Int. Cl.[5] ..... F04D 29/38

[52] U.S. Cl. ..... 416/132 A; 416/5; 416/214 R

[58] Field of Search ..... 416/5, 132 R, 132 A, 416/204 R, 214 R, 240; D23/377, 385, 411, 413, 414

[56] References Cited

U.S. PATENT DOCUMENTS

| | | | |
|---|---|---|---|
| 925,030 | 6/1909 | Russel | 416/5 |
| 925,031 | 6/1909 | Russel | 416/5 |
| 2,392,671 | 1/1946 | Husted | 416/5 |
| 5,110,261 | 5/1992 | Junkin | 416/132 A |

*Primary Examiner*—Edward K. Look
*Assistant Examiner*—James A. Larson
*Attorney, Agent, or Firm*—Pro-Techtor International

[57] ABSTRACT

An improved blade for a ceiling fan including a blade frame and a blade plate, wherein the blade frame is a hollow circular frame composed of a male member and a female member engaged therewith. The blade members are made from injection molded plastic, and secure a blade plate therebetween.

14 Claims, 6 Drawing Sheets

CEILING FAN BLADE

BACKGROUND OF THE INVENTION

The present invention relates to an improved blade for a ceiling fan, and more particularly is a blade composed of a blade frame manufactured by injection molding or die casting and including a tensionable blade plate.

It is known that a conventional blade of a ceiling fan is made of plywood or solid wood. In the manufacturing procedure, such a blade needs to go through a plurality of processing steps such as cutting, planing, multi-polishing, finishing, painting and printing or covering with printed paper, etc. Moreover, each blade must finally be weighed and three or four blades of the same weight must be selected as a set for the packing operation. Therefore, the whole processing procedure for a wooden blade is quite labor-intensive and time-consuming, and therefore expensive.

SUMMARY OF THE INVENTION

It is therefore a primary object of this invention to provide an improved blade for a ceiling fan. The blade comprises a blade frame made by injection molding or die casting and a blade plate made from a commercially available tensionable plastic or fabric. The structure greatly reduces manufacturing time and expense.

It is a further object of this invention to provide the above blade wherein each assembled blade has a controllable weight error falling within a tolerable range so that the weighing and selecting procedures performed before packing can be greatly simplified.

It is still a further object of this invention to provide the above blade wherein the blade frame is mass produced by plastic injection molding or aluminum alloy casting. The blade plate can be pre-printed with various colors and designs, and then mass cut by a cutter, whereby the production speed is greatly increased. Moreover, the blade frame and blade plate can be assembled by means of a specific assembling machine in a factory or assembled outside a factory by contract so that production can be greatly increased with less labor. Thus the manufacturing cost is greatly reduced.

It is still a further object of this invention to provide the above blade with a total weight which is 40–50% that of a conventional wooden blade. Therefore, the power of the blade-driving motor can be reduced according to the reduced weight. Therefore, the cost of the motor as well as of the blade is lowered.

According to the above objects, the blade of the present invention comprises a blade frame and a blade plate, wherein the blade frame is a hollow, long circular frame composed of a male member and a female member engaged therewith. The male and female members are made of plastic by injection molding or made of metal by die casting. The width of the blade frame is greater at a fixed end which attaches to a bracket of the ceiling fan. The blade plate is made of printable plastic or fabric which is shaped corresponding to the blade frame, but is slightly smaller. A blade plate locating means is disposed on the male or female member whereby before assembling the blade, the plate is first located on the male or female member and then the male and female members are associated together. Fixing means are disposed on the male and female members so as to Join the male and female members and the blade plate together when assembling the blade. The blade plate is first fixed between the male and female members by the blade plate locating means, and then the male and female members are engaged with each other by the fixing means to, together with the blade plate, form the blade of the ceiling fan.

The present invention can be best understood through the following description and accompanying drawings, wherein:

DETAILED DESCRIPTION OF THE PREFERRED EMBODIMENTS

Figure 1:
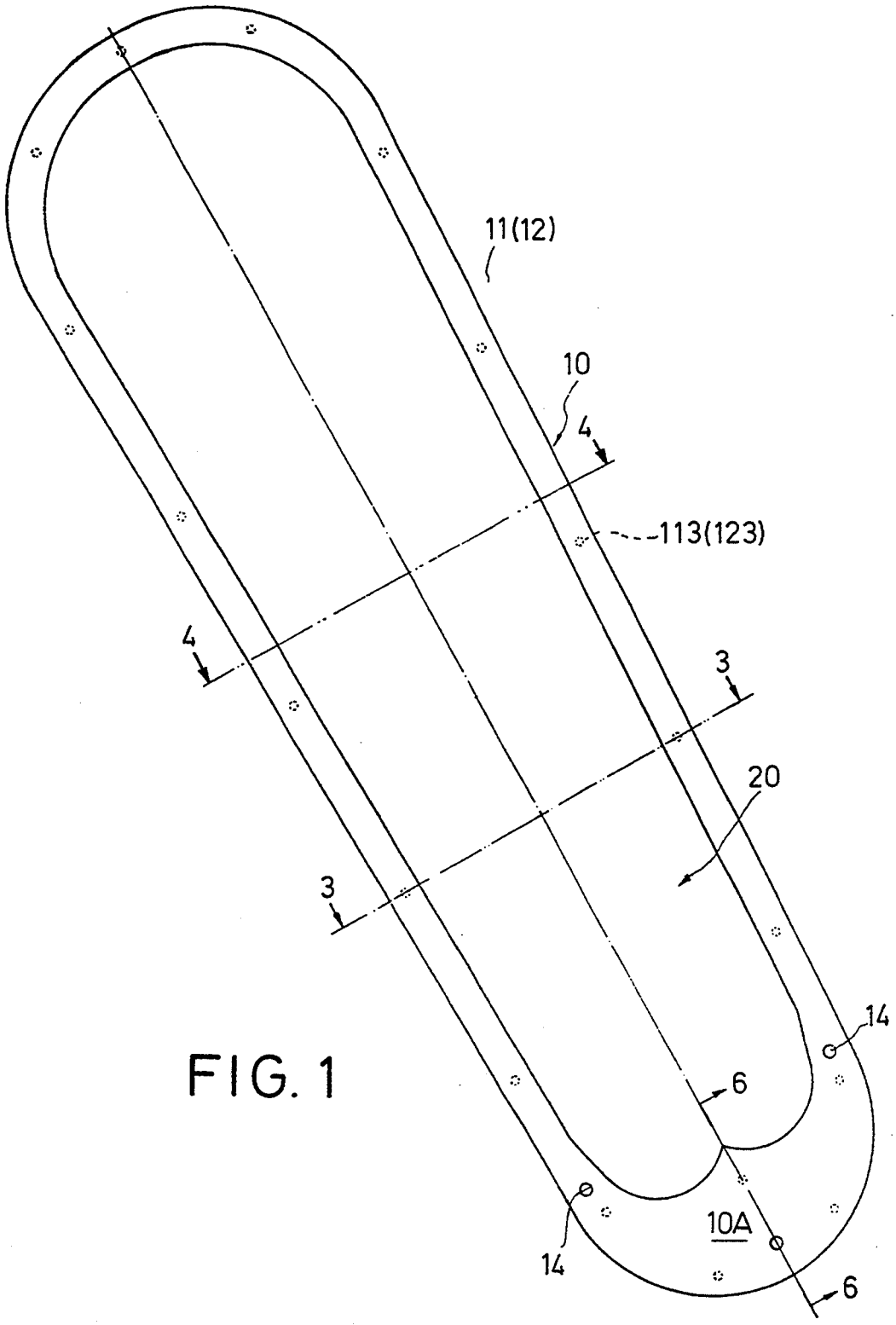
FIG. 1 is a top plan view of the blade of this invention.
Figure 2:
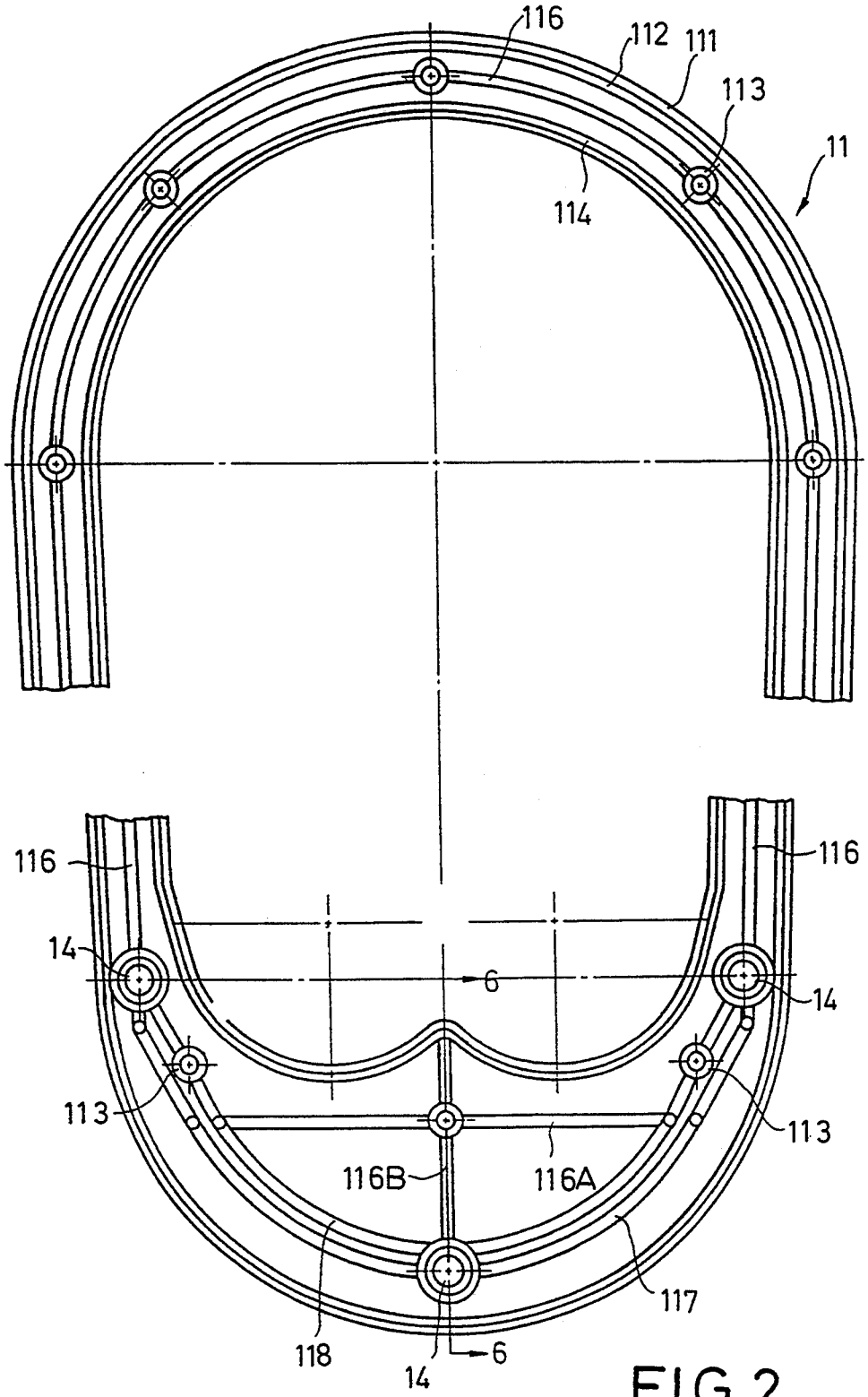
FIG. 2 is an enlarged view of a preferred embodiment of the female member of the blade frame thereof.
Figure 3:
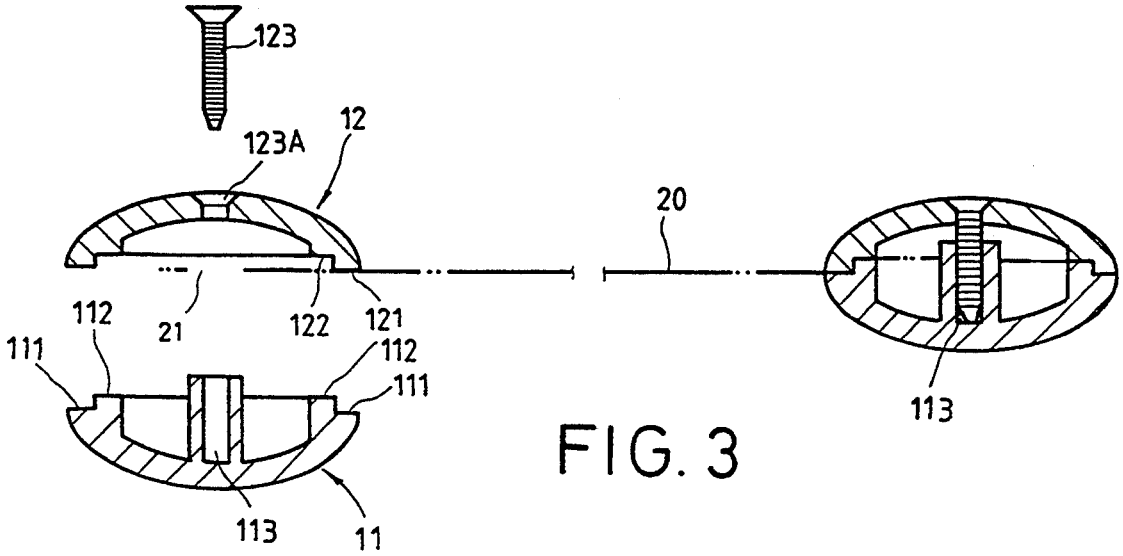
FIG. 3 is a sectional view taken on line 3—3 of FIG. 1, showing a preferred embodiment of the male and female members of the blade frame thereof.

Please refer to FIGS. 1–3. The blade for a ceiling fan of this invention includes a blade frame 10 and a blade plate 20. The blade frame 10 is a hollow long circular frame made of stiff plastic such as ABS which has been injection molded or made of die cast aluminum alloy. The blade frame 10 is composed of a male member 12 and a female member 11 connected thereto. The blade frame 10 has a wider (in the longitudinal axis) fixed end 10A which is fixed on a bracket of the ceiling fan (as shown in FIG. 1). The blade plate 20 can be made of commercially available plastic or fabric and is shaped corresponding to the blade frame 10. The periphery of the blade plate 20 is smaller than that of the blade frame 10 and is formed with multiple equally spaced fixing holes 21 whereby the blade plate 20 can be clamped and fixed between the male and female members 12, 11 to form the blade.

Figure 4:
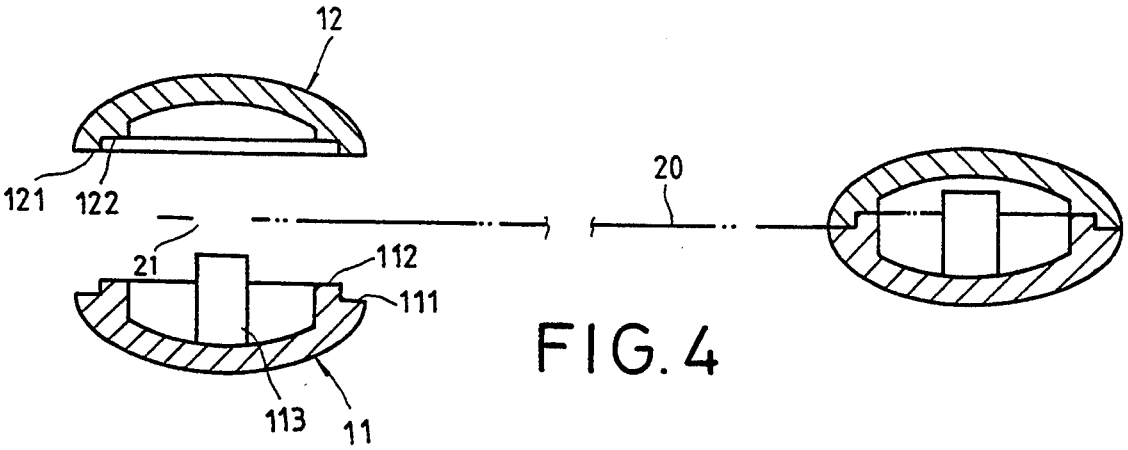
FIG. 4 is a sectional view taken on line 4—4 of FIG. 1.

The male and female members 12, 11 are disposed with fixing means for securing the male and female members 12, 11 to each other. A preferred embodiment of the fixing means is shown in FIG. 3, wherein equally spaced and vertically extending hollow posts 113 are disposed along an inner wall of the female member 11. An annular shoulder 111 and projection 112 are formed along the periphery of the female member 11. Fixing holes 123A having screws 123 are formed on an inner wall of the male member 12 which correspond to the hollow posts 113. An annular projection 121 and shoulder 122 are formed on the periphery of the male member 12 corresponding to the shoulder 111 and projection 112 of the female member 11. As shown in FIGS. 3 and 4, before the male member 12 is secured to the female member 11, the blade plate 20 is first placed on the female member 11 with the fixing hole 21 fitted with the hollow post 113 so that when the male member 12 is engaged with the female member 11, the blade plate 20 is prevented from displacing. Therefore, the hollow post 113 serves as a blade plate locating means.

As shown is FIGS. 3 and 4, during assembly, the fixing hole 21 of the blade plate 20 is first aligned and fitted with the hollow post 113 of the female member 11. The male member 12 is then engaged with the female member 11. Then the screw 123 is extended through the fixing hole 123A into the hollow post 113 and locked therein. Meanwhile, the periphery of the blade plate 20 is clamped between the projection 112, 121 and shoulder 111, 122 of the male and female members 12, 11 so that the blade plate 20 is fixed as well as overall evenly tensioned so that its surface is smooth. Therefore, the projection and shoulder of the male and female members serve as blade plate tensioning means.

In the above assembling procedure, a rack disposed with multiple electric screw drivers corresponding to the multiple fixing holes 123A of the male member 12 can be used to simultaneously screw the multiple screws 123 into the hollow post 113 of the female member 11 so that the assembling operation can be quickly and easily performed.

Figure 3A:
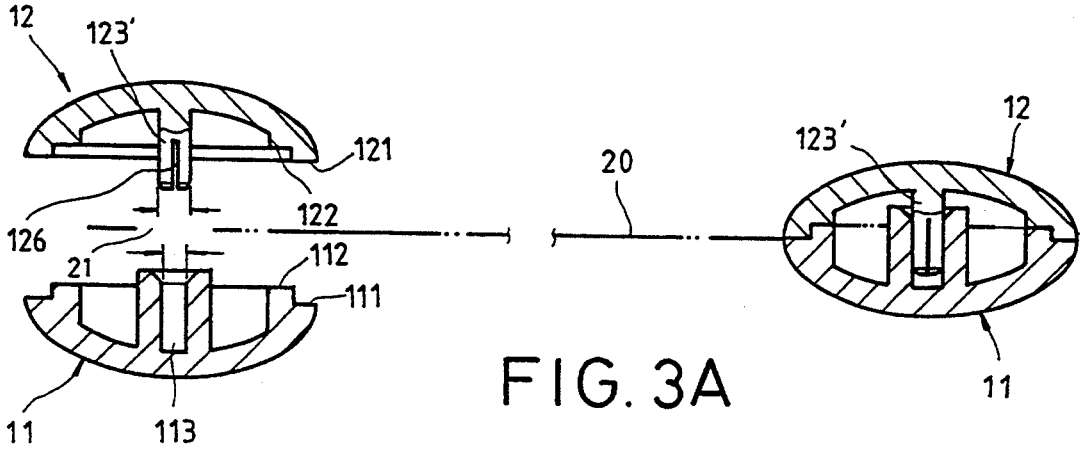
FIG. 3A is a sectional view taken on line 3—3 of FIG. 1 showing another embodiment.

As shown in FIG. 3A, the male member 12 can be alternatively disposed with an insert pin 123' instead of the fixing hole 123A and screw 123 of FIG. 3. The insert pin 123' has a central slit 126 and has an outer diameter slightly larger than the inner diameter of hollow post 113. When assembled, the fixing hole 21 of the blade plate 20 is first fitted with the insert pin 123' of the male member 12 or the hollow post 113 of the female member 11, and then the female member 12 and the male member 11 are engaged with each other with the insert pin 123' inserted into the hollow post 113. When the insert pin 123' is forced into the hollow post 113, the slit 126 of the insert pin 123' is elastically reduced, making the insert pin 123' tightly associated with the hollow post 113. Therefore, the insert pin and hollow post serve as a fixing means in this embodiment.

Figure 4A:
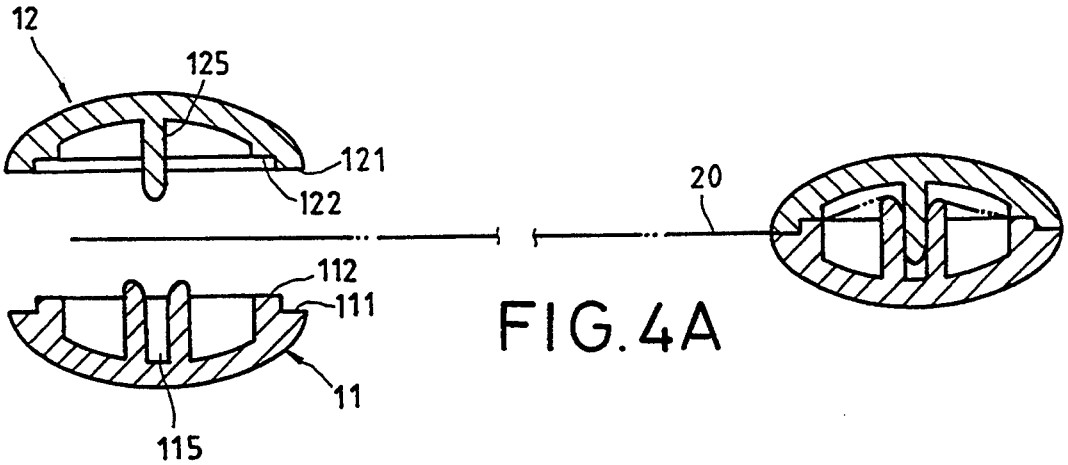
FIG. 4A is a sectional view taken on line 4—4 of FIG. 1 showing another embodiment.
Figure 4B:
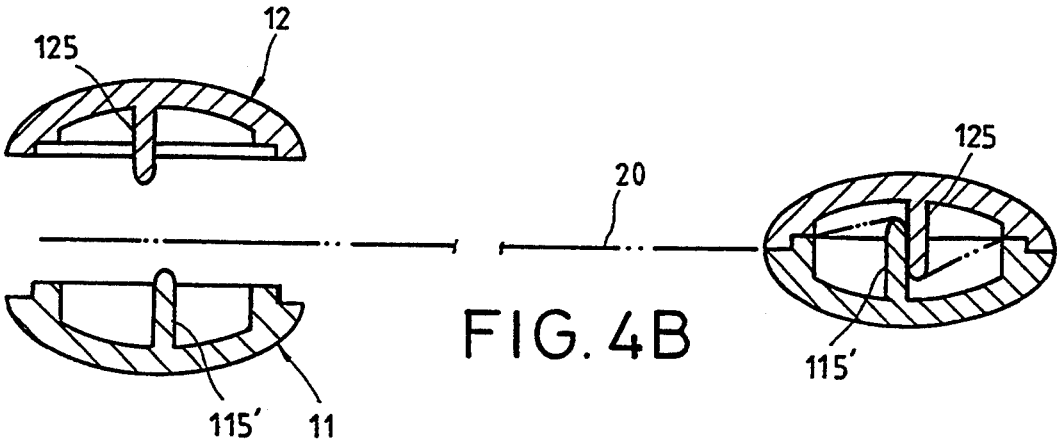
FIG. 4B is a sectional view taken on line 4—4 of FIG. 1 showing another embodiment.

As shown in FIGS. 4A and 4B, besides the projection and shoulder of the male and female members 12, 11, the blade plate tensioning means can further include an annular insert rib 125 formed on the inner wall of the male member 12 and projecting toward the female member 11, and an annular insert channel 115 as opposing rib 115' formed on the inner wall of the female member 11 corresponding to the annular insert rib 125. After the male member and female member 12, 11 are engaged together, the blade plate 20 is further tensioned into a U shape as shown in FIG. 4A. Similarly, the blade plate 20 can be tensioned into a double L shape as shown in FIG. 4B. If it is considered that the blade plate is over tensioned when U shape or double L-shape, the shoulder and projection of the male and female members can be reduced or even eliminated. This is related to the material and thickness of the blade and the design details of the projection and shoulder and will not be discussed further herein.

Figure 3B:
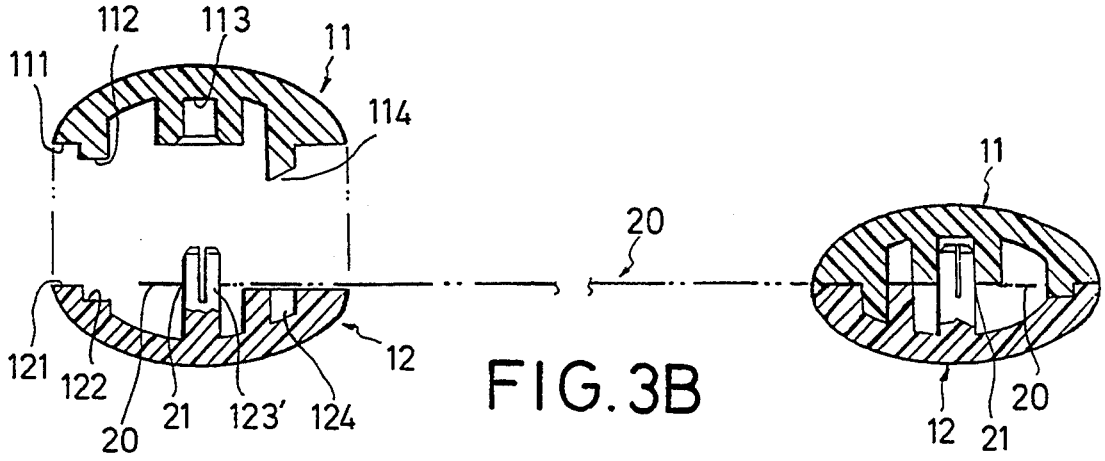
FIG. 3B is a sectional view taken on line 3—3 of FIG. 1 showing still another embodiment.

FIG. 3B shows another embodiment of the male and female members, wherein the outer periphery of the female member 11 is formed with a shoulder 111 and a projection 112 and the inner central portion of the female member 11 is formed with multiple equally spaced hollow posts 113. In addition, an annular downward projecting rib 114 is formed between the hollow posts 113 and the inner periphery of the female member 11. Correspondingly, the male member 12 is formed with an outer peripheral projection 121 and shoulder 122 and multiple equally spaced central insert pins 123' in accordance with the multiple hollow posts 113 of the female member 11. In addition, an annular insert recess 124 is formed between the insert pins 123' and the inner periphery of the male member 12 so that when the male and female members 12, 11 are engaged with each other, the insert pins 123' of the male member 12 are inserted into the hollow posts 113 of the female member 11 while the annular insert rib 114 of the female member 11 is inserted into the annular insert recess 124 of the male member 12.

It should be noted that the positioning of the rib 114 and the recess 124 could of course be reversed. That is, the rib 114 could be disposed on the male member 12 and the recess 124 could be disposed on the female member 11.

Therefore, when assembling the blade plate 20, the fixing holes 21 thereof are first fitted with the insert pins 123' of the male member 12 with the blade plate 20 covering the same. The female member 11 is then laid over the male member 12 with the annular rib 114 of the female member 11 extruding the outer periphery portion of the blade plate 20 into the annular insert recess 124 of the male member 12. Because the recess 124 has a considerable depth, a considerable length of the blade plate 20 is extruded into the recess 124 so that the blade plate 20 is quite tensioned and the male and female members 12, 11 are tightly associated together.

Figure 3C:
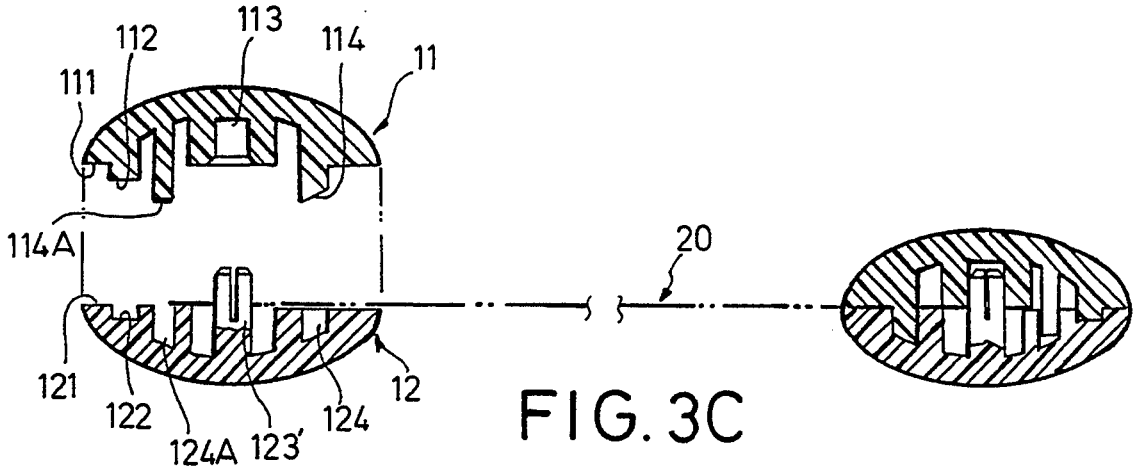
FIG. 3C is a sectional view taken on line 3—3 of FIG. 1 showing still another embodiment.

For further securing the blade plate 20 between the male and female members 12, 11, in another preferred embodiment, an annular projecting rib 114A can be formed on the female member 11 in addition to the annular projecting rib 114 as shown in FIG. 3C. Correspondingly, an additional annular insert recess 124A can be disposed on the male member 12, whereby the blade plate 20 can be more reliably secured between the male and female members 12, 11 without loosening or detaching therefrom.

Figure 6:
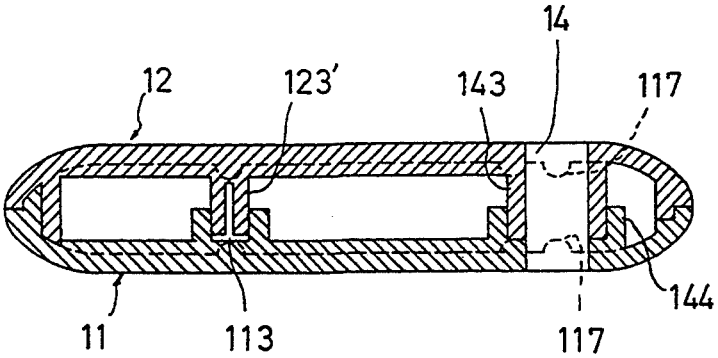
FIG. 6 is a sectional view taken on line 6—6 of FIG. 1.

The blade of this invention has a holding portion fixed on a blade bracket of the fan (not shown). As shown in FIG. 2, the surface portion of the holding portion is relatively large and formed therein with two reinforcing projecting ribs 116A, 116B arranged in a cross pattern. In addition, two arch reinforcing projecting ribs 117, 118 are disposed around the cross projecting ribs 116A, 116B. As shown in FIG. 6, the male member 12 has three hollow insert pins 143 at the holding portion while the female member 11 has three corresponding hollow posts 114 each of which has a through hole 14 at the holding portion, whereby means of nuts and screws extending through the through hole 14 of the holding portion and the bracket, the blade frame can be fastened to the bracket.

Figure 5:
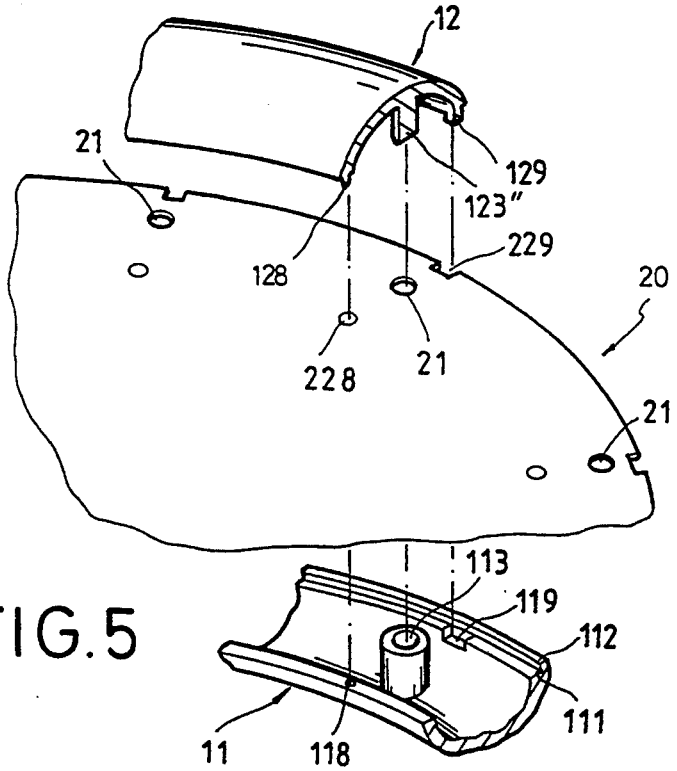
FIG. 5 shows another embodiment of the fixing means of the male and female members of the blade frame of this invention.

FIG. 5 shows still another embodiment of the fixing means of this invention, wherein the inner periphery of the female member 11 is formed with equally spaced orifices 118 and the outer periphery of the female member is formed with small concave openings 119. The inner periphery of the male member 12 is correspondingly formed with protuberances 128 and the outer periphery of the male member is correspondingly formed with small bosses 129. Moreover, the blade plate is punched with small circular holes 228 and recesses 229, whereby the protuberances 128, insert pins 123" and small bosses 129 of the male member 12 can go through the small circular holes 228, fixing holes 21 and recesses 229 of the blade plate 20 to engage with the orifices 118, hollow poets 113 and the concave openings 119 of the female member 11.

Thereafter, thermal fusion can be applied to the protuberances 128 and the orifices 118 and the small bosses 129 and concave openings 119 by means of ultrasonic waves or high frequency waves so as to join the male member, female member and blade plate into an integral body. If necessary, thermal fusion can also be applied to the insert pins 123" and hollow posts 113 to more firmly connect the blade frame with the blade plate. Certainly, in case the material of the blade plate is different from that of the blade frame and the aforesaid thermal fusion which is applied to fixed points cannot insure the firm connection between the male and female member and the blade plate, thermal fusion can be applied to the entire inner and outer peripheries of the male and female members. Alternatively, thermal fusion may be applied to fixed points of, or to the entire, blade plate tensioning means shown in FIGS. 3 and 3A and FIGS. 4, 4A and 4B. The fusing option chosen is determined by the materials of the male and female member and the blade plate and the dimensions thereof, as well as the assembly cost, and will not be discussed further herein.

I claim:

1. A blade for a ceiling fan comprising:

a blade frame and a blade plate;

said blade frame comprising a male member and a female member engaged therewith, said frame including a free end and a fixed end, said fixed end being attached to a bracket of the ceiling fan and having a greater longitudinal width than the free end of the frame to facilitate secure attachment to the ceiling fan bracket; and wherein said blade plate has a shape corresponding to that of the frame and the blade plate is smaller than the frame; and the blade includes blade plate locating means disposed on the frame to facilitate assembly of said blade frame and said blade plate, and wherein the blade further includes fixing means disposed on said male member and said female member to provide a means of attaching said male member to said female member.

2. A blade for a ceiling fan as claimed in claim 1 wherein:

said blade plate is stretched to a smooth position by radial tension applied evenly throughout the surface of said blade plate by tensioning means included on said male and female members, the tensioning means being positioned so as to apply tension to the blade plate by clamping the blade plate between the members of the blade frame.

3. A blade for a ceiling fan as claimed in claim 2 wherein :

said tensioning means comprises a pair of annular shoulder portions and a pair of complementary annular projecting portions disposed along peripheries of said male and female members such that when the male and female members are engaged, tension is evenly applied to the blade plate.

4. A blade for a ceiling fan as claimed in claim 2 wherein:

said tensioning means further includes an annular inset rib disposed on an inner wall of said male member and a corresponding annular insert channel disposed on an inner wall of said female member.

5. A blade for a ceiling fan as claimed in claim 2 wherein:

said tensioning means further includes at least a first annular projecting rib and a second annular projecting rib disposed respectively on an inner wall of said male member and on an inner wall of said female member, said first and second annular projecting ribs extending toward and adjacent to each other.

6. A blade for a ceiling fan as claimed in claim 2 wherein:

at least one annular projecting rib is disposed between an inner periphery and hollow posts disposed on said female member, and at least one annular insert recess is disposed on an inner periphery of said male member corresponding to said annular projecting rib of said female member, whereby fixing holes of said blade plate are fitted with insert pins of said male member and then said female member is associated with said male member so that said annular rib of said female member extrudes a periphery of said blade plate into said annular recess of said male member so that said blade plate is simultaneously tensioned and secured between said male and female members.

7. A blade for a ceiling fan as claimed in claim 6 wherein:

said annular insert recess is disposed on said female member and said annular rib is disposed on said male member.

8. A blade for a ceiling fan as claimed in claim 1 wherein:

said blade fixing means comprises multiple evenly spaced fixing holes disposed on an inner wall of said male member and multiple evenly spaced hollow posts disposed on an inner wall of said female member and vertically extending therefrom, the location of the hollow posts of the female member corresponding to the location of the fixing holes of said male member.

9. A blade for a ceiling fan as claimed in claim 1 wherein:

said fixing means comprises multiple evenly spaced fixing holes disposed on an inner wall of said male member and multiple evenly spaced hollow posts disposed on an inner wall of said female member and vertically extending therefrom, the location of the hollow posts of the female member corresponding to the location of the fixing holes of said male member, and further including multiple screws which pass through each fixing hole and into the corresponding hollow post.

10. A blade for a ceiling fan as claimed in claim 1 wherein:

said fixing means comprises multiple evenly spaced hollow posts disposed on an inner wall of said female member and vertically extending therefrom and multiple evenly spaced insert pins disposed on an inner wall of said male member and vertically extending therefrom, the location of the hollow posts of the female member corresponding to the location of the insert pins of said male member;

each of said inset pins having a slit in a free end and having an outer diameter larger than an inner diameter of the hollow posts so that said insert pins are compressed when inserted into said hollow posts, forming a tight bond and securing the male member to the female member.

11. A blade for a ceiling fan as claimed in claim 1 wherein:

said fixing means comprises multiple protuberances disposed on an inner periphery of said male member and with bosses disposed on an outer periphery of said male member, the protuberances and bosses corresponding to equally spaced orifices disposed on an inner periphery of said female member and with concave openings disposed on an outer periphery of said female member, and wherein multiple corresponding in location circular holes and recesses are disposed on said blade plate, whereby;

when said male and female frame members are engaged, insert pins, said protuberances and said bosses of said male member pass through fixing holes, said circular holes, and said recesses of said blade plate respectively, and mate with hollow posts, said orifices and said concave openings, and are secured in place with thermal fusion.

12. A blade for a ceiling fan as claimed in claim 1 wherein:

after said male and female members are engaged, thermal fusion is used to bond insert pins and hollow posts to bond the male and female members.

13. A blade for a ceiling fan as claimed in claim 1 wherein:

after said male and female members are engaged, thermal fusion is used to bond the entire peripheries of the male and female members.

14. A blade for a ceiling fan as claimed in claim 1 wherein:

said blade has said fixed end fixed on said bracket of said ceiling fan, a male member portion of said fixed end including insert pins formed with through holes and a female member portion of said fixed end including hollow posts corresponding to said insert pins of said male member portion so that said insert pins are received by said hollow posts.

* * * * *